US009435606B2

(12) United States Patent
Chia

(10) Patent No.: US 9,435,606 B2
(45) Date of Patent: Sep. 6, 2016

(54) HINGED ARM SAFETY MECHANISM FOR FOAM DART LAUNCHER

(71) Applicant: Easebon Services Limited, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 14/697,133

(22) Filed: Apr. 27, 2015

(65) Prior Publication Data

US 2015/0226518 A1 Aug. 13, 2015

Related U.S. Application Data

(63) Continuation of application No. 14/295,545, filed on Jun. 4, 2014, now Pat. No. 9,032,945.

(60) Provisional application No. 61/881,619, filed on Sep. 24, 2013, provisional application No. 61/830,939, filed on Jun. 4, 2013.

(51) Int. Cl.
*F41B 11/70* (2013.01)
*F41B 11/641* (2013.01)
*F41B 11/89* (2013.01)

(52) U.S. Cl.
CPC ..... *F41B 11/641* (2013.01); *F41B 11/70* (2013.01); *F41B 11/89* (2013.01)

(58) Field of Classification Search
USPC ..... 124/66, 56, 73
See application file for complete search history.

(56) References Cited

U.S. PATENT DOCUMENTS 2,609,468 A * 9/1952 Gubbins ..... B23B 45/001 124/31
3,734,075 A * 5/1973 Staples ..... A63B 69/406 124/49
4,168,695 A * 9/1979 Haller ..... A63B 69/408 124/16
4,212,285 A 7/1980 Cagan et al.
4,257,613 A * 3/1981 Meyer Thor Straten ..... F42B 6/003 473/574
4,325,351 A * 4/1982 Yuasa ..... A63B 69/406 124/53.5
5,323,755 A * 6/1994 Hsieh ..... F41B 11/54 124/59
5,373,832 A 12/1994 D'Andrade
5,529,050 A 6/1996 D'Andrade
5,711,285 A * 1/1998 Stewart ..... F41B 11/642 124/67
5,724,954 A 3/1998 Smith
5,901,693 A 5/1999 Smith (Continued)

OTHER PUBLICATIONS

U.S. Appl. No. 61/881,619, filed Sep. 24, 2013.

(Continued)

*Primary Examiner* — Michael David
(74) *Attorney, Agent, or Firm* — Amster, Rothstein & Ebenstein, LLP

(57) ABSTRACT

A dart launcher comprises a housing, a safety arm, and a trigger. The housing includes a launching section configured to receive a dart having a minimum threshold length. The safety arm is movably attached to the housing and extends at least partially across the launching section. The safety arm is positioned so that the dart having the minimum threshold length engages at least a portion of the safety arm upon insertion into the launching section. The trigger is movable with respect to the housing and is operable to cause the dart having the minimum threshold length to launch from the launching section.

19 Claims, 11 Drawing Sheets

(56) References Cited

U.S. PATENT DOCUMENTS 5,975,068 A 11/1999 Halter et al.
6,159,112 A * 12/2000 Ciluffo ..... A63B 69/0024 124/4
6,364,162 B1 4/2002 Johnson et al.
6,523,535 B2 * 2/2003 Rehkemper ..... F41B 4/00 124/78
6,915,793 B2 * 7/2005 Vanek ..... F41B 4/00 124/78
7,537,001 B2 5/2009 Ma
8,387,605 B2 3/2013 Brown et al.
8,402,956 B2 3/2013 Dakan et al.
8,402,958 B2 * 3/2013 Victor ..... F41A 9/73 124/45
8,567,378 B2 10/2013 Nugent
8,567,380 B2 10/2013 Nugent
8,596,254 B2 12/2013 Brooks et al.
8,875,688 B2 11/2014 Nugent
8,955,503 B2 * 2/2015 Corsiglia ..... F42B 6/00 124/78
9,022,016 B1 * 5/2015 Hafer ..... F41B 4/00 124/6
9,032,945 B2 5/2015 Chia
2003/0176245 A1 * 9/2003 Cyr ..... F42B 12/385 473/578
2004/0261778 A1 * 12/2004 Wilmot ..... A63B 69/406 124/78
2005/0172943 A1 * 8/2005 Cucjen ..... A63B 69/406 124/6
2006/0236993 A1 * 10/2006 Cucjen ..... A63B 69/406 124/78
2006/0283431 A1 * 12/2006 Lee ..... F41A 9/30 124/41.1
2009/0056693 A1 * 3/2009 Pedicini ..... F41B 11/723 124/73
2009/0217918 A1 * 9/2009 McKenzie ..... A63B 69/406 124/78
2012/0304975 A1 12/2012 Ma
2013/0267356 A1 * 10/2013 Levin ..... A63B 63/00 473/476
2014/0239591 A1 * 8/2014 Rehkemper ..... A63H 17/008 273/317
2014/0352677 A1 * 12/2014 Chia ..... F41B 11/70 124/66
2015/0308782 A1 * 10/2015 Chia ..... F41B 11/70 124/78
2016/0018175 A1 * 1/2016 Lallier ..... F41A 9/73 124/25.6

OTHER PUBLICATIONS

U.S. Appl. No. 61/830,939, filed Jun. 4, 2013.
U.S. Appl. No. 14/794,155, filed Jul. 8, 2015.

* cited by examiner

HINGED ARM SAFETY MECHANISM FOR FOAM DART LAUNCHER

CROSS-REFERENCE TO RELATED APPLICATION

The present application is a Continuation of U.S. patent application Ser. No. 14/295,545, filed on Jun. 4, 2014, which claims the benefit of and priority to each of U.S. Provisional Patent Application No. 61/830,939, filed on Jun. 4, 2013, and U.S. Provisional Patent Application No. 61/888,619, filed Sep. 24, 2013, the entire contents of each of which are incorporated by reference herein.

FIELD

The present invention generally relates to a safety arm for a foam dart launcher having a safety mechanism.

SUMMARY

The present invention generally relates to a safety feature for a foam dart launcher, and in embodiments, to a hinged arm safety mechanism configured to inhibit launching of a non-standard dart or other object having a length less than a minimum threshold length from a foam dart launcher.

According to an exemplary embodiment of the present invention, a foam dart launcher includes a loading section configured to receive at least one dart. The foam dart launcher includes a safety arm that extends across the launching chamber and prevents launching of the at least one dart if the at least one dart is less than a defined minimum length. The safety arm may be a hinged arm that is configured to be contacted and biased out of a resting or blocking position by a dart having a length equal to or greater than a defined minimum length.

In embodiments, a dart launcher may include a trigger, a piston, an actuating lever, a fluid delivery conduit, a magazine for containing at least one dart and at least one corresponding cartridge and configured to elevate the at least one dart and at least one corresponding cartridge into a launching section, and/or a safety arm. The safety arm may have an end corresponding to a minimum length for the dart. If a non-standard dart having a length less than the minimum length is inserted into the launching section, the safety arm prevents the non-standard dart from launching.

According to an exemplary embodiment of the present invention, a dart launcher comprises a housing, a safety arm, and a trigger. The housing includes a launching section configured to receive a dart having a minimum threshold length. The safety arm is movably attached to the housing and extends at least partially across the launching section. The safety arm is positioned so that the dart having the minimum threshold length engages at least a portion of the safety arm upon insertion into the launching section. The trigger is movable with respect to the housing and is operable to cause the dart having the minimum threshold length to launch from the launching section.

In an exemplary embodiment, the safety arm has an end corresponding to a position of the minimum threshold length along the launching section.

In an exemplary embodiment, the safety arm is pivotably attached to the housing.

In an exemplary embodiment, the safety arm is configured to inhibit the movement of an object having a length less than the minimum threshold length through the launching section.

In an exemplary embodiment, the launching section is configured to receive a cartridge that is adapted to retain at least a portion of the dart.

In an exemplary embodiment, the dart launcher further comprises a magazine configured to advance one or more darts into the launching section.

In an exemplary embodiment, the safety arm is configured to return to an initial position following launching of the dart from the launching section.

In an exemplary embodiment, the dart launcher further comprises a piston tube configured to transmit fluids into the launching section.

In an exemplary embodiment, the piston tube is configured to transmit pressurized fluids into the launching section so that a pressure differential causes the dart to launch.

In an exemplary embodiment, actuation of the trigger causes pressurized fluids to enter the launching section from the piston tube.

According to an exemplary embodiment of the present invention, a dart launcher comprises a housing, a loading member, and a safety arm. The housing has an elongate barrel portion and includes a launching section formed along the barrel portion. The loading member is rotatably supported by the housing and includes at least one chamber configured to receive a dart having a minimum threshold length. The loading member is rotatable to bring the at least one chamber into axial alignment with the barrel portion. The safety arm extends at least partially across the launching section in an initial position. The safety arm is movably supported by the housing so that the safety arm can be rotationally engaged and moved away from the launching section by the dart having the minimum threshold length into a second position so that the dart can pass through the launching section.

In an exemplary embodiment, the safety arm is pivotably supported by the housing.

In an exemplary embodiment, the safety arm is configured to return to the initial position after the dart has passed through the launching section.

In an exemplary embodiment, the safety arm is configured inhibit the passage though the launching section of an object having a length less than the minimum threshold length.

In an exemplary embodiment, the dart launcher further comprises a piston assembly.

In an exemplary embodiment, the piston assembly includes a piston tube configured to transmit fluids to the barrel portion.

In an exemplary embodiment, the piston assembly includes a plunger movably disposed in the piston tube to expel fluids into the barrel portion.

In an exemplary embodiment, the dart launcher comprises a trigger assembly.

In an exemplary embodiment, the trigger assembly includes a chamber lock configured to maintain the loading member in a substantially stationary rotational position.

In an exemplary embodiment, the movable trigger is configured to disengage the chamber lock so that the loading member can rotate with respect to the housing.

BRIEF DESCRIPTION OF THE DRAWINGS

Various exemplary embodiments of this invention will be described in detail, with reference to the following figures, wherein.

DETAILED DESCRIPTION

Figure 1:
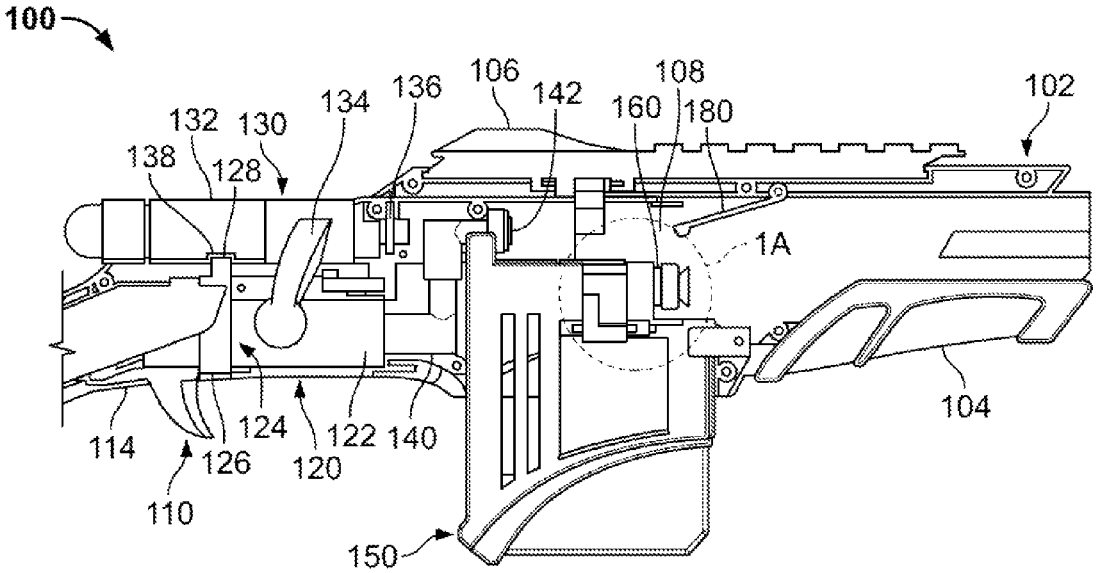
FIG. 1 is a side, cut-away view of a portion of a dart launcher according to an exemplary embodiment of the present disclosure.

The present invention is directed towards a dart launcher, for example, a toy foam dart launcher. More specifically, the present invention is directed towards a dart launcher incorporating a safety arm that prevents, blocks, interferes with, and/or otherwise inhibits, in whole or in part, non-standard darts or other undesirable objects from being launched from the dart launcher. In embodiments, non-standard darts may be broken, shortened and/or deformed darts.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 1A:
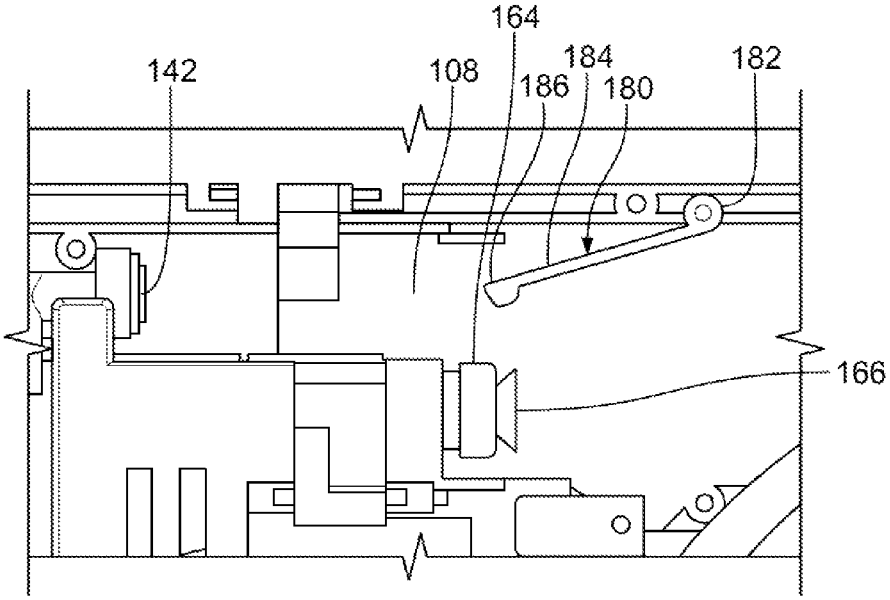
FIG. 1A is an enlarged view of the area of detail identified in FIG. 1.

Referring to FIGS. 1 and 1A, a dart launcher according to an exemplary embodiment of the present invention is generally described as 100. Dart launcher 100 may be configured to launch one or more darts 160 therefrom. In embodiments, darts 160 may be non-lethal projectiles for use in recreational activities.

Dart launcher 100 includes a housing 102 with a hollow interior to accommodate internal components of the dart launcher 100. The housing 102 of dart launcher 100 may have an elongate configuration, such as that of a rifle stock, to facilitate handling by a user. In embodiments, housing 102 of dart launcher 100 may include various external handling or mounting structures, such as an underside grip 104 or mounting rail 106. Mounting rail 106 may be configured to receive various accessories for dart launcher 100, for example, a scope, a source of illumination, and/or a sighting member, to name a few. Underside grip 104, mounting rail 106, and various other external structures may be attached and/or connected and/or interfit and/or otherwise coupled with housing 102. In embodiments, underside grip 104 and/or mounting rail 106 may be monolithically formed with the housing 102 of dart launcher 100.

In the exemplary embodiment shown, dart launcher 100 comprises a trigger 110, a piston assembly 120, an actuating lever 130, a fluid delivery conduit 140, a magazine 150 for containing darts 160, and a safety arm 180. In embodiments, dart launcher 100 may comprise additional and/or alternative components.

Trigger 110 is configured to control launching of at least one dart 160 from the dart launcher 100. Trigger 110 may be pivotably attached to the housing 102 of dart launcher 100 so that trigger 110 is configured to move through a degree of rotation relative to the housing 102. Accordingly, trigger 110 may incorporate a biasing member, such as a spring, to maintain a bias on the trigger 110 toward an unstressed position. Trigger 110 may include an engagement extent 112 that is configured to releasably engage a portion of piston 120. Trigger 110 may be configured for direct engagement, for example, with one or more fingers of a user, such as an index finger. In embodiments, trigger 110 may include friction-enhancing surface features, such as grooves, ridges, and/or a non-slip coating, to name a few. In embodiments, trigger 110 may have an ergonomic configuration to facilitate engagement by a user's hand.

Piston 120 may include a piston member 122 having a hollow interior configured to accommodate a biasing member, such as a spring and a plunger coupled to the end of the spring (not shown). Piston member 122, as shown, may be a hollow cylindrical member. In embodiments, piston member 122 may have a variety of cross-sectional profiles and configurations, such as a rectangular box, a prism, a spherical member, or an ovoid member, to name a few. Piston member 122 also comprises an actuating ring 124 slidably disposed along an outer surface of the piston member 122 and include a radially outward flange 126 that is configured to engage engagement extent 114 of the trigger 110. An interior engagement feature of actuating ring 124 may be engaged with the spring and/or plunger of piston 120 such that movement of the actuating ring 124 along the piston member 122 causes compression or expansion of the spring, and subsequent movement of the plunger through the piston member 122 (not shown). Actuating ring 124 may also include a tab 128 extending away from the radially outward flange 126 and configured to engage a portion of the actuating lever 130, as described herein.

Actuating lever 130, as shown, is an elongate member having a body 132 and a handle 134 extending therefrom.

Actuating lever 130 may be slidably disposed along a top portion of the housing 102 of dart launcher 100, as shown. In embodiments, actuating lever 130 may include an engagement flange 136 that is disposed within an interior portion of the housing 102. Body 132 may include a notch 138 that may be configured to receive the tab 128 of the actuating ring 124 of piston 120. In this manner, lever 130 is configured such that proximal or distal movement of the lever 130 causes corresponding movement of the actuating ring 124 of piston 120 to cause movement of the spring and plunger disposed therein.

Fluid conduit 140 is fluidly coupled with the piston member 122 of piston 120 and extends toward a launching section 108 within the housing 102. In embodiments, launching section 108 may be at least an internal portion of the housing 102 along an elongate, forward portion of a dart launcher known in the art as a barrel. Fluid conduit 140 may be configured to transmit fluids between the piston 120 and launching section 108. The path of the fluid conduit 140 between the piston member 122 and launching section 108 may be determined by the internal geometry of the housing 102. In embodiments, fluid conduit 140 may incorporate one or more bends, as shown. A forward end of the fluid conduit 140 may include a nozzle 142. Nozzle 142 may be a tapered member so that nozzle 142 narrows to a region of reduced diameter relative to the remainder of fluid conduit 140 so that fluids traveling through nozzle 142 may experience an increase in pressure upon exiting the narrowed end of nozzle 142. Nozzle 142 may be in fluid communication with the launching section 108.

As described above, dart launcher 100 includes a magazine 150 for receiving one or more darts 160. Magazine 150 may be a substantially elongate member having an interior chamber for accommodating darts 160. In embodiments, magazine 150 may include an elevator to bias darts 160 disposed within the magazine 150 upwards toward the launching section 108. In embodiments, the elevator may comprise a base with a spring or platform disposed within the magazine 150. In this manner, magazine 150 may be configured to automatically and sequentially advance multiple darts 160 into launching position within the dart launcher 100. Magazine 150 may be releasably coupled with the housing 102 such that magazine 150 may be, for example, replaced or refilled with additionally darts 160. In embodiments, a dart launcher may be configured to include magazines of a variety of configurations, such as a revolving member including multiple launching sections, a drum containing darts, or a strip of darts fed into a launching section, to name a few.

Each dart 160 is an elongate member that includes a body 162 and a blunted end portion 164. Dart launcher 100 may be configured for use with darts 160 of a predetermined length L (FIG. 3A) that may correspond to a limit determined by safety arm 180, as will be described herein. Body 162 of dart 160 may be formed of a lightweight material ideal for use in a projectile, such as foam. End portion 164 may be disposed on a forward direction of travel of dart 160 and may have a softened configuration to minimize the risk of injury to persons, animals, and/or property. In embodiments, end portion 164 may incorporate a cap, coating, or other softening material, such as a polymeric material. In embodiments, end portion 164 may include additional and/or alternative safety features, for example, a blunted or rounded end portion. End portion 164 of dart 160 may also include a suction member 166 having a concave interior configured to evacuate fluids therefrom upon impact with a surface. Accordingly, suction member 166 may be formed of a deformable material configured to flatten upon an impact such that darts 160 may be adhered to surfaces via vacuum pressure.

Figure 2:
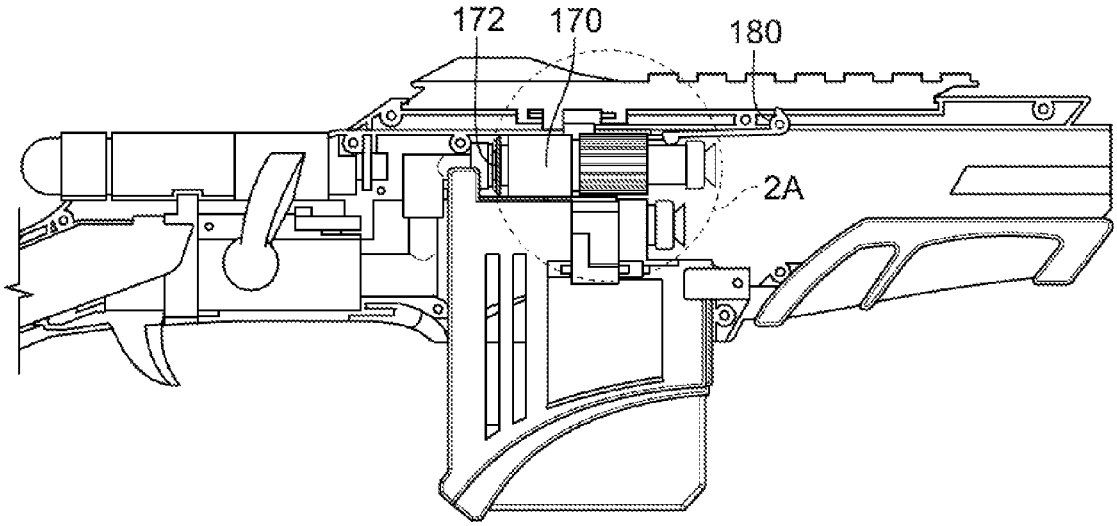
FIG. 2 is a cut-away view similar to FIG. 1, with a dart and cartridge being elevated through a magazine of a dart launcher and engaging a safety arm according to an exemplary embodiment of the present disclosure.
Figure 2A:
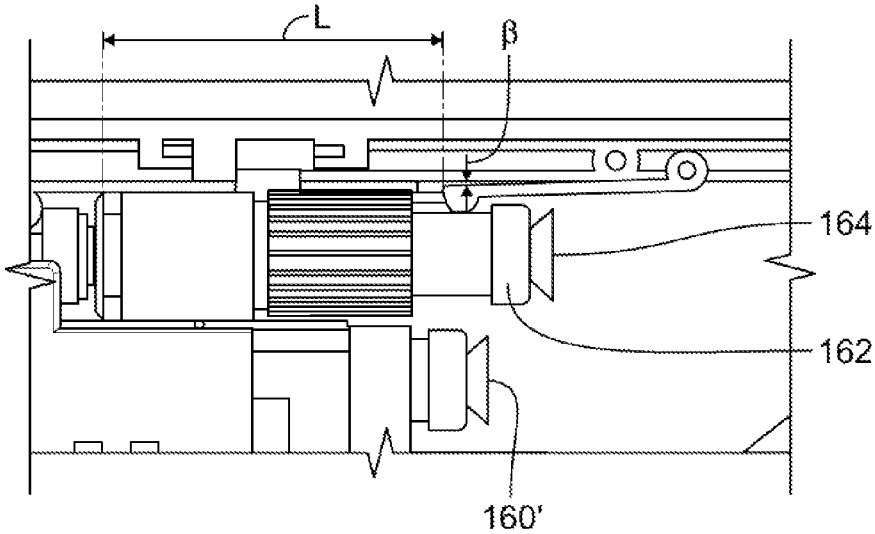
FIG. 2A is an enlarged view of the area of detail identified in FIG. 2.

Turning to FIGS. 2 and 2A, darts 160 may be configured to be disposed within a cartridge 170 prior to launching. One or more cartridges 170 can be stored in magazine 150. In this manner, magazine 150 may be configured to accommodate the combined dimension of the darts 160 and respective cartridges 170. Cartridge 170 may be an elongate member that includes an interior channel configured to accommodate the body 162 of a dart 160. Cartridge 170 may be dimensioned such that a tail portion of the body 162 and blunted end portion 164 of dart 160 protrude from the cartridge 170. In this regard, cartridge 170 has an open ended configuration adapted for insertion and/or removal of a dart 160 therein. Cartridge 170 may also include a partially closed end 172 that has an aperture (not shown). The partially closed end 172 of cartridge 170 may be positioned within the magazine 150 such that, upon advancement into the launching section 108, the aperture of the partially closed end 172 may be positioned adjacent the exit of the nozzle 142. In this manner, nozzle 142 may be in fluid communication with the interior of the cartridge 170. In embodiments, the aperture of the partially closed end 172 of cartridge 170 may have a similar or smaller diameter than the exit of the nozzle 142.

Safety arm 180 is disposed forwardly of the launching section 108. Safety arm 180 may be an elongate, lever-like member that is coupled with an interior surface of the housing 102. In embodiments, safety arm 180 may be pivotably attached about a post formed on the housing 102. In embodiments, safety arm 180 may be coupled to a top interior surface of the housing 102 so that the safety arm 180 may extend downwardly toward the launching section 108. In embodiments, safety arm 180 may extend at least partially across the launching section 108 so that at least a portion of safety arm 180 extends into alignment with a point within an outer circumference of launching section 108. In embodiments, safety arm 180 may extend to a point in front of, coextensive with, and/or along launching section 108. Safety arm 180 may be configured for relative movement with respect to the housing 102 of dart launcher 100. In embodiments, safety arm 180 may be a flexible and/or resilient member, such as a leaf spring, configured to deform under an applied load. In embodiments, safety arm 180 may include a hub 182 and a body 184 extending therefrom. Hub 182 may be pivotably attached to a top interior surface of the housing 102, such that body 184 extends toward launching section 108 at an angle $\alpha$ with respect to the top interior surface of the housing 102 in a resting or initial position. In embodiments, angle $\alpha$ may be an angle between and including about 0 degrees and about 90 degrees. In embodiments, a stop on hub 182 and corresponding ledge or other engagement surface formed on the interior of housing 102 may limit the degree of motion of safety arm 180 such that body 184 may not form an angle greater than a with the top interior surface of the housing 102. A torsion spring or other biasing member may be disposed within the hub 182 or another portion of safety arm 180 to maintain a bias toward the resting or initial position of safety arm 180. In embodiments, the strength of a spring or biasing member may be chosen such that the downward bias of the leg 184 does not interfere with and/or alter the trajectory of a dart 160 launched from the dart launcher 100 and/or deform dart 160 in any manner so that the shape, form, structure, and/or integrity of dart 160 is substantially maintained. In embodiments, safety arm 180 may be devoid of a spring and may return to its resting position at least partially under the influence of gravity. An end 186 of the body 184 of safety arm 180 may correspond to a minimum threshold length L for launching a dart. Minimum threshold length L may correspond to a relatively safe and/or recommended minimum length for a dart or other object to be launched from dart launcher 100.

In use, a user may grasp or otherwise engage dart launcher 100. The user may insert magazine 150 into the housing 102 so that a dart 160, disposed in a cartridge 170, is advanced into the launching section 108. Because the dart 160 is at least the minimum threshold length L determined by the safety arm 180, a portion of the dart 160 and/or, in embodiments, cartridge 170, may engage the body 184 of safety arm 180 and move the body 184 to pivot about hub 182 and approximate toward the top interior surface of the housing 102. In this manner, upon loading of a dart 160 and corresponding cartridge 170 into launching section 108, safety arm 180 may be engaged to move and form a different angle, such as a smaller angle β, with respect to the top interior surface of the housing 102. A user may then grasp handle 134 of lever 130 and retract the body 132 of lever 130 so that the notch 138 of body 132 carries the tab 128 of the actuation ring 124 therewith. Because the actuation ring 124 is operably coupled with the spring and plunger of the piston 120 (not shown), retraction of the lever 130 may cause the spring to compress and the plunger to retract within the piston member 122. As the actuation ring 124 approaches a rearward position in the piston member 122, the engagement extent 114 of trigger 110 may cam over the radially outward flange 126 of actuation ring 124. The trigger 110 may then be biased into a resting position, for example, by a trigger spring or other biasing structure. In this regard, the actuation ring 124, and thereby the spring and plunger of the piston 120, may be maintained in a rearward position. In embodiments, dart launcher 100 may incorporate a locking member to maintain actuation ring 124 and/or the spring and/or plunger of piston 120 in a rearward or other position.

The user may then actuate or squeeze the trigger 110 such that the trigger 110 may pivot with respect to housing 102. Engagement extent 114 may travel radially away from the radially outward flange 126 of actuation ring 124. The unconstrained spring within the piston member 122 may then expand within the piston member 122, advancing the plunger therealong. As the plunger travels through the piston member 122, pressurized fluids such as air within the piston member 122 are forcibly transmitted into fluid conduit 140 (not shown). The plunger of the piston 120 may sealably contact the opening of the fluid conduit 140 to minimize the loss of pressurized air from fluid conduit 140. Pressurized fluids may flow through the fluid conduit 140 toward the nozzle 142. As fluids approach the tapered end of nozzle 142, fluids may increase in pressure due to the smaller area of the nozzle exit. Pressurized fluids may then enter into the aperture of the partially closed end 172 of cartridge 170. Because the rear end of the dart 160 may be seated within the cartridge 170, fluids entering the cartridge 170 from the nozzle 142 may create a pressure differential so that a region of greater pressure within the cartridge 170 is formed behind the dart 160 as compared to the ambient pressure forward of the dart 160. This pressure differential may launch the dart 160 out of the cartridge 170 and toward an exit aperture of the housing 102 and away from the dart launcher 100. The empty cartridge 170 may then be removed from launching section 108 in any suitable manner, for example, automatic ejection through an aperture in housing 102 or manual removal, to name a few.

Figure 3:
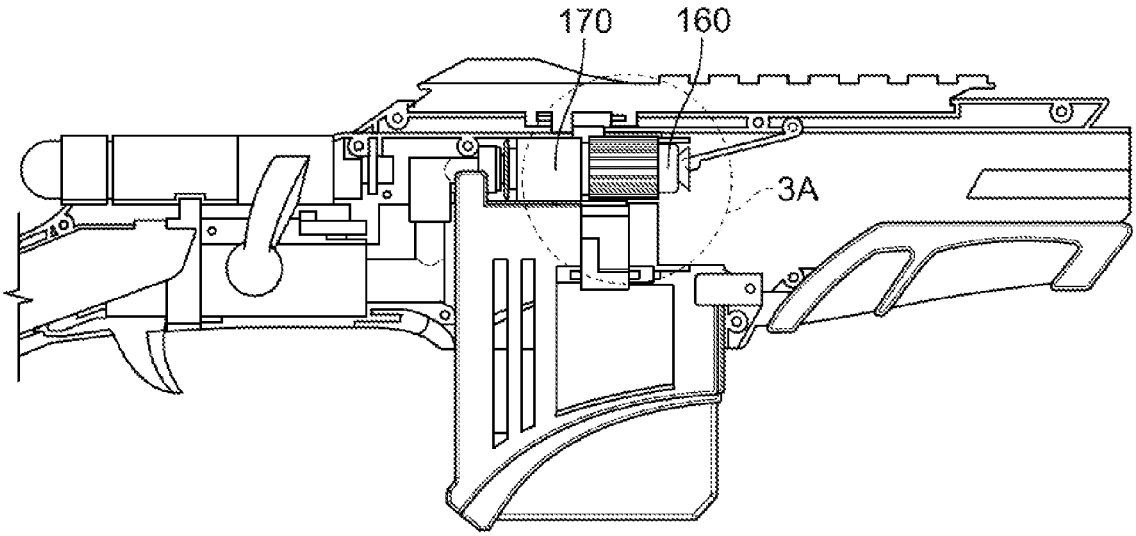
FIG. 3 is a cut-away view similar to FIG. 2, illustrating a non-standard dart being elevated through a magazine of a dart launcher according to an exemplary embodiment of the present disclosure.
Figure 3A:
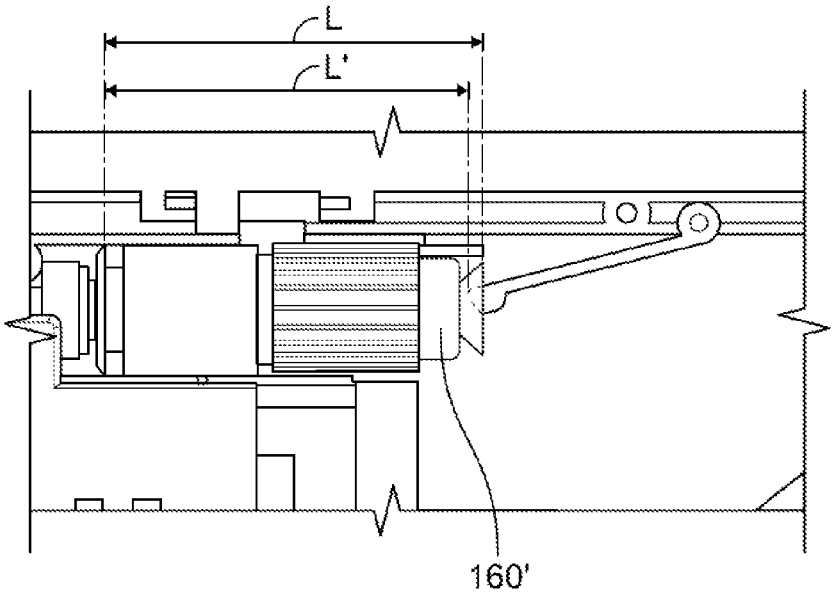
FIG. 3A is an enlarged view of the area of detail identified in FIG. 3.

Referring to FIGS. 3 and 3A, once the empty cartridge 170 of the previous dart 160 is removed from the launching section 108, the next sequential cartridge 170 within the magazine 150 may be elevated into the launching section 108. The cartridge 170 shown in FIG. 3 houses an object other than dart 160. In embodiments, cartridge 170 may house a non-standard dart 160'. Non-standard dart 160' may be similar to dart 160 described above, but has a length L that is less than the minimum threshold length L determined by the safety arm 180. It will be understood that an object other than a non-standard dart 160' having a length less than the minimum threshold length L can be inhibited from launching by the safety arm 180 in the same manner described above. Accordingly, the non-standard dart 160 may be disposed behind of the safety arm 180 upon advancement into the launching section 108 by the elevator of magazine 150, and does not engage the safety arm 180 in the manner described above with respect to dart 160 above. In this regard, safety arm 180 may remain in its resting position or initial position, with the body 184 extending downward toward the launching section 108. The end 186 of the body 184 of safety arm 180 may be positioned in radial registration with a portion of the non-standard dart 160' such that at least the end 186 of the body 184 is disposed along a linear path defined between a portion of non-standard dart 160' and an exit defined by the housing 102.

Preparation for launching non-standard dart 160' may proceed in a similar manner as described herein with respect to dart 160. However, at least the end 186 of body 184 may effectively inhibit movement of non-standard dart 160' from advancing past the launching section 108. In this manner, safety arm 180 may provide a safety feature that inhibits launching of a non-standard dart 160' having less than the minimum threshold length L and may obviate or render redundant a separate safety arm for trigger 110 to accomplish the same or a similar task.

Figure 4:
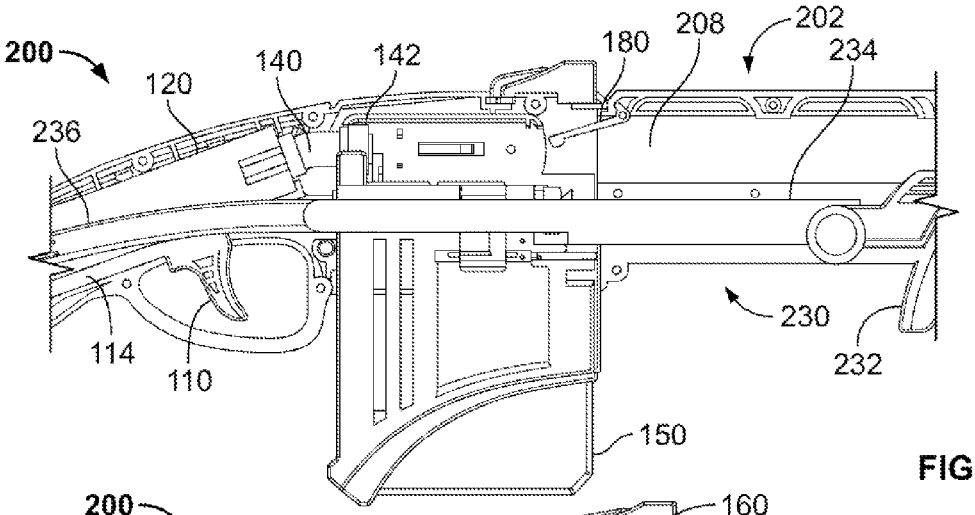
FIG. 4 is a side, cut-away view of a portion of dart launcher according to an exemplary embodiment of the present disclosure.

Turning to FIG. 4, an alternative embodiment of a dart launcher is generally designated as 200. Dart launcher 200 may be similar to dart launcher 100, and similar components will be described with similar reference numerals such that dart launcher 200 will only be described with respect to the differences therein. Dart launcher 200 may include a housing 202 having a launching section 208. Dart launcher 200 may also include a trigger 110, a piston 120, a fluid delivery conduit 140 having a nozzle 142, a magazine 150 containing darts 160 and corresponding cartridges 170, a safety arm 180, and/or an actuation handle 230.

Actuation handle 230 may include a grip 232 (FIG. 6) that is slidably disposed with respect to housing 202 and a forward actuation member 234 coupled with the grip 232. Actuation handle 230 may also include a rear actuation member 236 that may be hingably coupled with the forward actuation member 234. Rear actuation member 236 may be operably coupled with the engagement extent 114 of the trigger 110 and piston 120.

Figure 5:
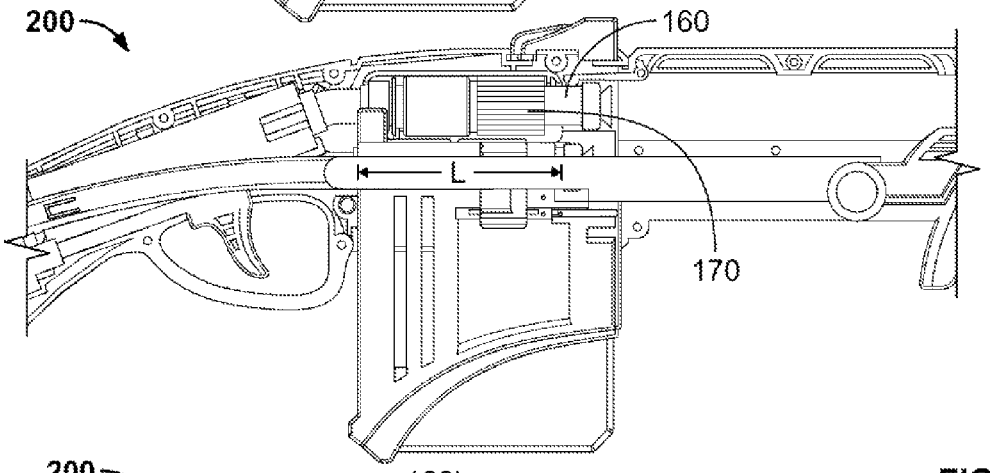
FIG. 5 is a cut-away view similar to FIG. 4, with a dart and cartridge being elevated through a magazine of a dart launcher and engaging a safety arm according to an exemplary embodiment of the present disclosure.

Referring additionally to FIG. 5, in use, a user may load magazine 150 containing darts 160 and cartridges 170 into housing 202 so that a dart 160 and corresponding cartridge 170 may be elevated into launching section 208. Dart 160, having the minimum threshold length L, may engage the safety arm 180 in the manner described above with respect to dart launcher 100. A user may engage and move the grip 232 so that the forward actuation member 234 is urged toward the rear of housing 202. Because the rear actuation member 236 is hingably coupled with the forward actuation member 234, retraction of the forward actuation member 234 may cause the rear end of the rear actuation member 236 to shift upwardly within the housing 202 to actuate piston 120. Launching of dart 160 may proceed in the manner described above with respect to dart launcher 100.

Figure 6:
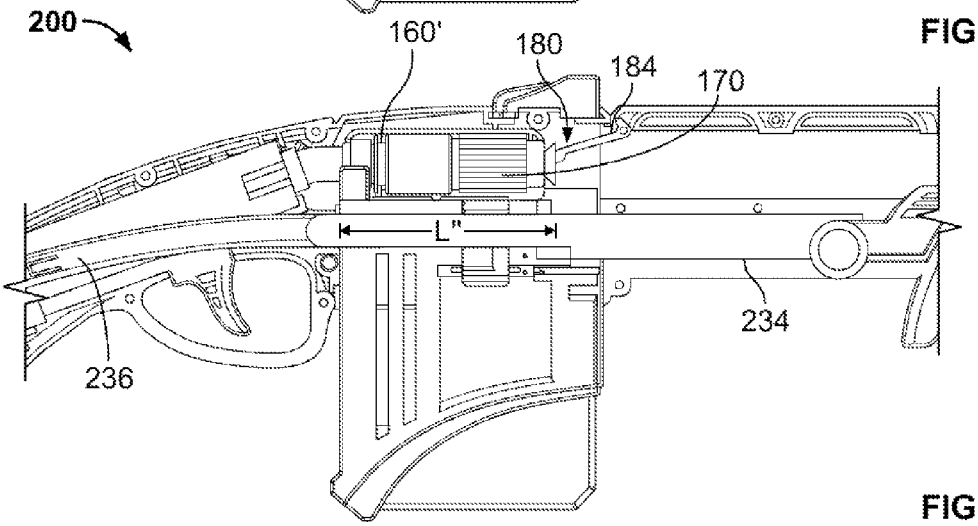
FIG. 6 is a cut-away view similar to FIG. 5, illustrating a non-standard dart being elevated through a magazine of a dart launcher according to an exemplary embodiment of the present disclosure.

Turning to FIG. 6, a non-standard dart 160' is shown loaded with a cartridge 170 into the launching section 208. Because non-standard dart 160' has a length L" less than the minimum threshold length L, non-standard dart 160' may not engage safety arm 180 and the body 184 of safety arm 180 may inhibit the launch of non-standard dart 160' in the manner described above with respect to dart launcher 100.

Figure 7A:
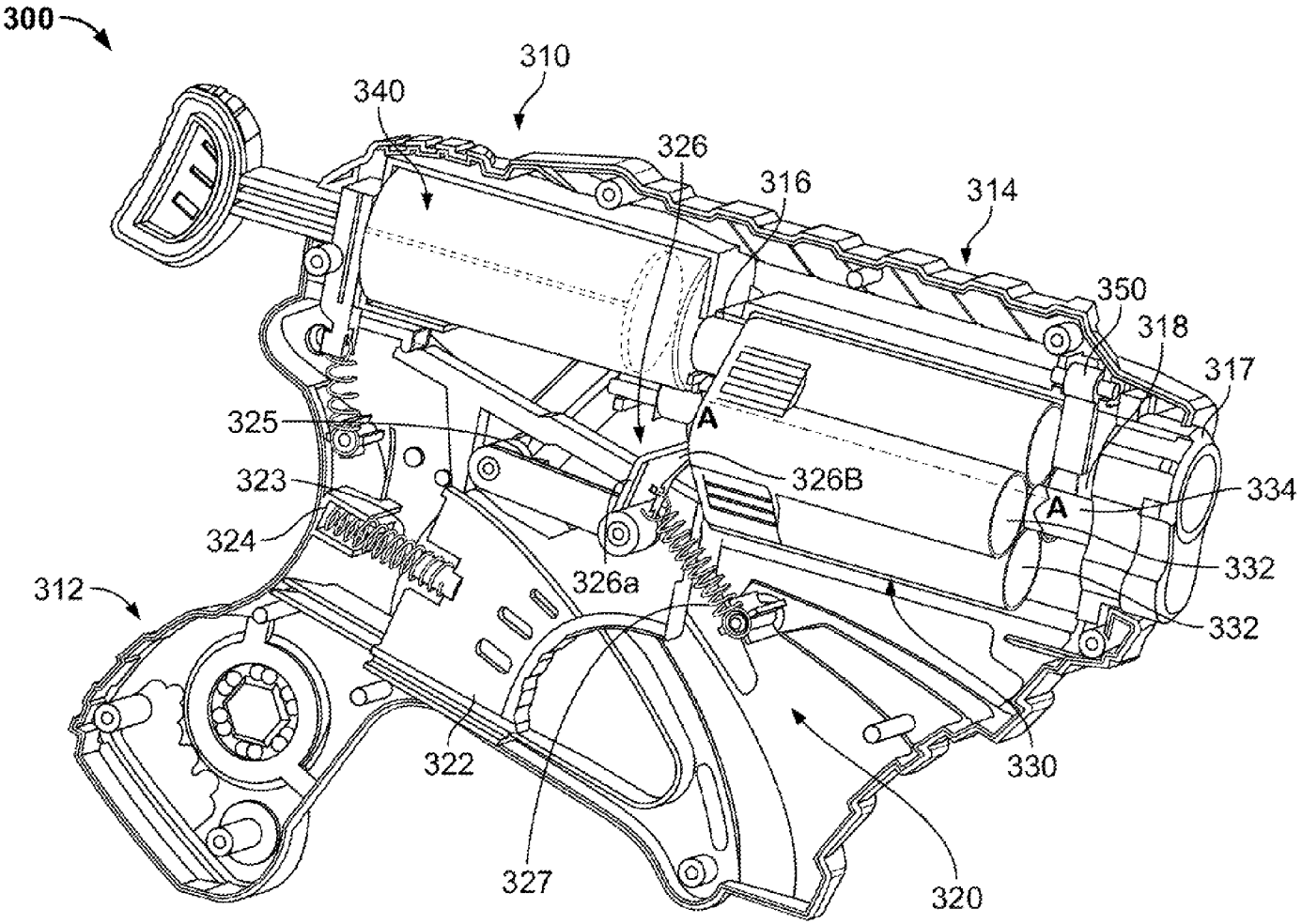
FIG. 7A is a perspective view, shown partially in cut-away, of an exemplary embodiment of a dart launcher.
Figure 7B:
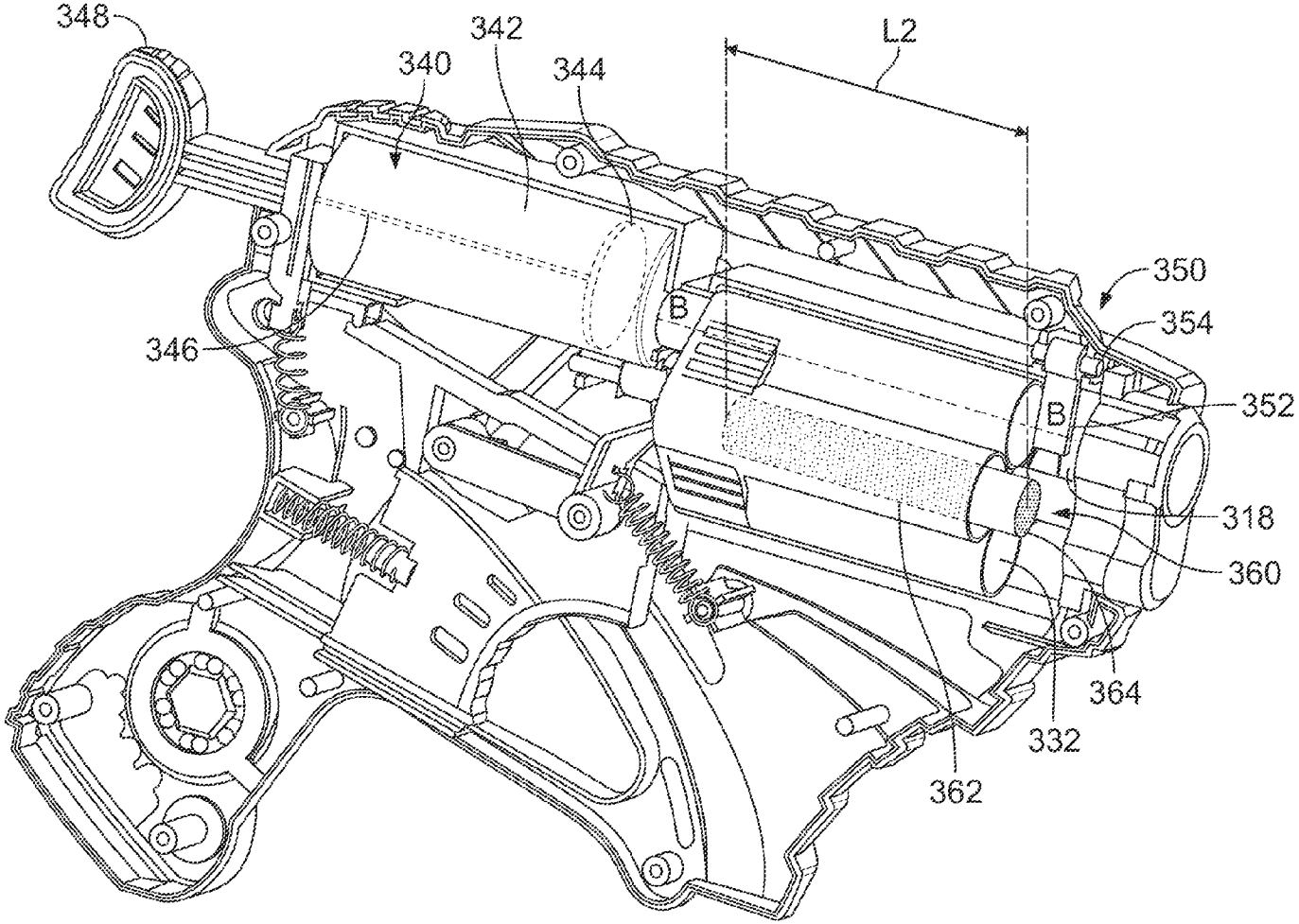
FIG. 7B is a perspective view, shown partially in cut-away, of the dart launcher of FIG. 7A, with a dart inserted therein in a first rotational position.

Turning to FIGS. 7A and 7B, a dart launcher according to an exemplary embodiment of the present disclosure is generally designated as 300. Dart launcher 300 may be configured to launch one or more darts 360.

Dart 360 includes a body 362 and a head 364. Dart launcher 300 may be configured for use with a dart 360 having a pre-determined length L2 that corresponds to a minimum threshold length associated with a dart or other object that may be safely and/or properly launched from dart launcher 300. At least body 362 of dart 360 may be comprised of a lightweight material ideal for use in a projectile, such as foam. Head portion 364 of dart 360 is disposed on an end of dart 360 associated with forward direction of travel of dart 360. Head portion 364 of dart 360 may have a softened and/or blunted configuration to minimize the risk of injury and/or discomfort to persons and/or animals and/or property. In embodiments, dart 360 may have a variety of configurations, such as arrows, bolts, balls, bullets, or other projectiles, to name a few. Dart launcher 300 may be configured to launch one dart 360 or multiple darts 360. In embodiments, dart launcher 300 may be configured to launch one or more objects in addition to or in place of one or more dart 360. In embodiments, dart 360 may have a substantially similar configuration to dart 160 (FIG. 1) described herein.

In the exemplary embodiment shown, dart launcher 300 comprises a housing 310, a trigger assembly 320, a loading member 330, a piston 340, and a safety arm 350. Housing 310 may provide a mounting structure, for example, a foundation, framework, or base, upon which one or more other components of dart launcher 300 may be assembled. In embodiments, various components of dart launcher 300 may be coupled, mounted, connected, or attached, to name a few, to housing 310. In embodiments, housing 310 may provide one or more surfaces by which a user, may engage, and/or access dart launcher 300.

Still referring to FIGS. 7A and 7B, housing 310 may have an at least partially hollow configuration so that one or more recesses may be present in an interior portion of housing 310. In embodiments, housing 310 one or more components of dart launcher 300 may be disposed on one or more interior recesses of housing 310. Housing 310 may be formed from a variety of materials, such as metallic materials, composites, and/or polymeric materials, to name a few. Housing 310 may have an integrally formed configuration so that housing 310 is a single monolithically formed piece. In embodiments, housing 310 may have at least one portion formed by mechanical deformation, such as cutting, milling, or grinding, to name a few. In embodiments, housing 310 may be molded by injection and/or extrusion molding. In embodiments, housing 310 may be formed of several coupled components such as housing sections coupled together with fasteners, adhered, joined at interlocking features, or ultrasonically or otherwise welded, to name a few.

Housing 310, as shown, may include a handle portion 312 and a barrel portion 314. Handle portion 312 may be configured as a narrowed and/or elongate portion of housing 310 extending in a generally orthogonal direction with respect to an underside of dart launcher 300 during typical operation of dart launcher 300. In embodiments, handle portion 312 may extend toward a floor or other ground surface during typical operation of dart launcher 300. Handle portion 312 may have a profile that is suitable for engagement by a hand or other portion of a user. Handle portion 312 may be configured as a pistol-type grip about which a user's palm and/or fingers may be placed to support dart launcher 300 in a user's hand. In embodiments, handle portion 312 may include surface features to enhance a gripping surface available to a user, such as ribs, grooves, a frictionally-enhancing surface treatment and/or coating, and/or an ergonomic profile, to name a few.

Barrel portion 314 may be configured as a narrowed and/or elongate portion of housing 310 extending in a generally forward direction with respect to the remainder of housing 310. In embodiments, barrel portion 314 may be disposed substantially orthogonal to handle portion 312. Barrel portion 314 may include a barrel 316 that may have an elongate tubular configuration such that a dart 360 may travel through barrel 316 toward a muzzle 317 to exit dart launcher 300. Muzzle 317 may form an exit portion of dart launcher 300. An axis B may extend through barrel portion 314 along which dart 360 may travel. Barrel 316 may include a launching section 318 to the rear of muzzle 317. In this regard, launching section 318 may be an at least partial discontinuity or cutout along barrel 316 such that launching section 318 may be configured as an entry or insertion location for a dart 360 into the barrel 316.

Trigger assembly 320 comprises a movable trigger 322 that is configured to move with respect to housing 310. In embodiments, movable trigger 322 may include a portion disposed within an interior portion of housing 310, and/or a portion exposed outside of housing 310. Movable trigger 322 may be coupled with a biasing member, such as a trigger spring 323. Trigger spring 323 may be attached to a portion of housing 310 such that trigger spring 323 maintains a biasing force against movable trigger 322. In embodiments, trigger spring 323 may provide a predetermined resistance to movement so that trigger spring 323 provides tactile feedback to a user and/or inhibits inadvertent actuation of dart launcher 300. In embodiments, trigger spring 323 may maintain a biasing force on movable trigger 322 such that movable trigger 322 is biased to return to a resting or initial position. In embodiments, movable trigger 322 may incorporate a stop 324 that may be configured to limit a distance along which movable trigger 322 can travel with respect to housing 310 or other components of dart launcher 300. In embodiments, movable trigger 322 may be pivotably coupled with a portion of housing 310 such that movable trigger 322 may be pivotable with respect to housing 310.

Trigger assembly 320 comprises a link 325 attached along a portion of movable trigger 322. Link 325 may be configured as an arm, bar, or extension, that may position and support a chamber lock 326 that is attached to one or both of link 325 and movable trigger 322. In embodiments, chamber lock 326 may be fixedly or pivotably attached to link 325 and/or movable trigger 322. Chamber lock 326 may be configured to move upon movement of the movable trigger 322. Chamber lock 326 may have a body **326*a* and an engagement portion 326*b* that may be configured to contact and/or interengage a portion of loading member 330, as described further herein. Body 326*a* and engagement portion 326*b* of chamber lock 326 may be angled with respect to one another to accommodate the internal geometry of dart launcher 300. Chamber lock 326 may be attached to a biasing member, such as a lock spring 327 that is attached to a portion of housing 310 so that lock spring 327 can maintain a pressing or pulling biasing force against chamber lock 326. Lock spring 327 may guide and/or control movement of the chamber lock 326 within housing 310. In embodiments, loading member 330 may incorporate a rotational biasing member, such as a torsion spring (not shown), to maintain a rotational bias against loading member 330 to bias loading member 330 to rotate. In such embodiments, a torsion spring may bias loading member 330 in a clockwise direction from the perspective of a user behind handle portion 312 so that loading member 330 may rotate when chamber lock 326 is disengaged from loading member 330 toward an unlocked position. In embodiments, loading member 330 may rotate in a counter-clockwise direction. In embodiments, trigger assembly 320 may include a secondary trigger, such as a cam, boss, or lever (not shown), to name a few, to cause rotation of loading member 330. In such embodiments, a secondary trigger may be independent of or in mechanical cooperation with movable trigger 322. In embodiments, loading member 330 may be laterally movable with respect to housing 310. In embodiments, loading member 330 may be hingably or slidably supported along a portion of housing 310 so that loading member 330 can be moved to an offset position with respect to barrel portion 314**.

With continued reference to FIGS. 7A and 7B, loading member 330 may be disposed at least partially within housing 310. In embodiments, housing 310 may include an interior cavity within which loading member 330 may be at least partially disposed. Loading member 330 includes one or more tubular portions arranged about a common center, such as a clover-shaped cross-sectional profile. In embodiments, loading member 330 may have a variety of cross-sectional profiles, such as circular, elliptical or polygonal, to name a few. Loading member 330 includes one or more dart chambers 332 therein that are bores or recesses formed within loading member 330 adapted to receive a dart 360 or other object. In embodiments, dart chambers 332 may extend entirely through loading member 330 or through a portion of the loading member 330. Dart chambers 332 may have a complementary dimensioning and/or cross-sectional and/or side profile, to darts 360. In embodiments, loading member 330 may include one or more dart chambers 332, such as 1, 2, 3, 4, 5, 6, 7, or 8, to name a few. Dart chambers 332 may be arranged in a symmetrical or an asymmetrical pattern within loading member 330. In embodiments, dart chambers 332 may be arranged in an evenly-spaced, circumferential pattern about loading member 330.

Loading member 330 may be configured to rotate about an axis A. Axis A may be defined through a geometric center of loading member 330. Loading member 330 may be coupled with a rotation mount 334, such as an axle or pin, that may be attached to another portion of dart launcher 300, such as a portion of housing 310. In embodiments, at least a portion of loading member 330 may be exposed outside of the housing 310. In embodiments, loading member 330 may be at least partially disposed within an interior portion of housing 310 and have at least a portion protruding or extending through an external surface of housing 310, such as a cutout formed along a portion of housing 310. In such embodiments, loading member 330 may present a surface by which a user can engage and rotate loading member 330 about axis A from outside the housing 330. In embodiments, a dart chamber 332 may be at least partially disposed outside housing 310 so that a user may access one or more dart chambers 332. Exemplary embodiments of dart launchers including rotatable loading members are disclosed in U.S. Pat. No. 8,353,277, the entire disclosure of which is incorporated by reference herein.

Still referring to FIGS. 7A and 7B, piston assembly 340 may include a piston tube 342, a plunger 344, a plunger arm 346, and/or a plunger handle 348. Piston assembly 340 may be configured to provide a force, such as via a fluid pressure differential, to launch dart 360 away from dart launcher 300. Piston assembly 340 may be configured to intake and/or store and/or transmit pressurized fluids. Piston assembly 340 may be fluidly coupled with the barrel portion 314 of housing 310, via tubes or other fluid conduits (not shown).

Piston tube 342 may be a hollow, elongate member configured such that fluids may be disposed therein. Piston tube 342 may extend along a portion of the length of the dart launcher 300, such as an interior portion of housing 310. In embodiments, piston tube 342 may have a circular cross-section. In embodiments, piston tube 342 may be a hollow cylindrical member. In embodiments, piston tube 342 may have a different configuration, such as a rectangular box, a prism, a spherical shape, or an ovoid-shape, to name a few. Piston tube 342 may include one or more apertures such that fluids may enter and/or exit piston tube 342 to pressurize and/or depressurize piston tube 342. Piston tube 342 may be configured to receive a plunger 344 within an interior portion of piston tube 342 so that plunger 344 is slidably disposed within the piston tube 342. Plunger 344 may have a complementary cross-sectional configuration to piston tube 342. In embodiments, plunger 344 may be configured as a circular disc. Plunger 344 may have a substantially fluid tight fit with the piston tube 342 so that forward or rearward movement of the plunger 344 through the piston tube 342 may cause a change of pressure of fluids in the piston tube 342. In embodiments, plunger 344 may be advanced toward a rear end of the piston tube 342 to provide a vacuum pressure to draw fluids into piston tube 342. In embodiments, plunger 344 may be advanced toward a forward end of the piston tube 342 to provide positive pressure so that fluids are expelled through a forward end of the piston tube 342. In embodiments, piston tube 342 may incorporate one or more fluid flow controlling members, such as valves, so that fluids may be drawn into or expelled from piston tube 342 upon reaching a threshold pressure provided by plunger 344. In such embodiments, this configuration may inhibit unintended leakage of fluids from and/or into piston tube 342 and/or to provide greater control over the operation of piston assembly 340 by a user.

Plunger arm 346 may be attached to a portion of plunger 344 and extend rearward through piston tube 342. In embodiments, plunger arm 346 may have a substantially rigid configuration so that forces such as axial pushing and/or pulling forces may be transmitted to plunger 344 via plunger arm 346. Plunger arm 346 may extend through a rear wall of piston tube 342 and/or housing 310 such that a portion of plunger arm 346 is disposed outside of housing 310. A portion of the plunger arm 346 disposed outside the housing 310 is coupled with a plunger handle 348 such that a user may engage plunger arm 346 via plunger handle 348. In embodiments, a user may engage plunger handle 348 to move plunger 344 through piston tube 342 so that a pressure of fluids inside the piston tube 342 is changed. In embodiments, plunger 344 and/or plunger arm 346 may be provided with a biasing member such as a spring (not shown), to maintain a biasing force on plunger 344 and/or plunger arm 346 to return to a resting position and/or to provide a predetermined resistance to motion. In embodiments, plunger 344 and/or plunger arm 346 may incorporate a locking mechanism (not shown) to maintain plunger 344 and/or plunger arm 346 in a predetermined position, such as a retracted position. In such embodiments, a locking mechanism may be engaged and/or disengaged by movable trigger 322.

Safety arm 350 is configured to inhibit the launching of an object having a length less than a minimum threshold length from the dart launcher 300. Safety arm 350 may include a body 352 extending away from a hub 354. Body 352 may have an elongate configuration, such as a rectangular box. In embodiments, body 352 and/or hub 354 may have a variety of cross-sectional configurations, such as circular, square, or triangular, to name a few. In embodiments, body 352 may have a tapered configuration. Hub 354 may be fixedly or pivotably coupled along a portion of housing 310 such that body 352 may extend at least partially across the launching section 318 of barrel 316. In embodiments, an end of body 352 of safety arm 350 may extend into alignment with a point within the outer circumference of, launching section 318 of barrel portion 314. Body 352 may extend at least partially across launching section 318 of barrel portion 314 to at least partially obstruct launching section 318. Safety arm 350 may be movably, such as via hinge or other pivotable structure, coupled to housing 310 so that at least body 352 of safety arm 350 may be engaged and moved away from the launching section 318 of barrel portion 314. In embodiments, hub 354 includes an opening to receive a coupling member, such as a pin, for coupling safety arm 350 with housing 310. In embodiments, hub 354 may be fixedly coupled with housing 310. Body 352 of safety arm 350 may have a flexible and/or resilient configuration such that at least body 352 of safety arm 350 may be deformed, bent, and/or deflected away from the launching section 318 of barrel portion 314. In embodiments, safety arm 350 may incorporate biasing member such as a spring (not shown), to maintain a biasing force on safety arm 350 to bias safety arm 350 toward a resting position.

In use, a user may access handle portion 312 of dart launcher 300 and load or insert a dart 360 into one or more chambers 332 in the loading member 330. In embodiments, a user may move loading member 330 to an offset position with respect to barrel portion 314 of housing 314 such that a user may access one or more chambers 332 and insert one or more darts 360 into respective chambers 332 of loading member 330. In embodiments, loading member 330 may be positioned such that one or more chambers 332 may be accessible to a user from outside housing 310, for example, through a cutout side portion of the housing 310, so that a user may insert a dart 360 into a chamber 332 externally of housing 310.

A dart 360 may be disposed in a chamber 332 that is radially and/or laterally offset from the barrel portion 314. In embodiments, a dart 360 may be disposed in a chamber 332 located at a 3:00 position from the perspective of a user behind the handle portion 312 of housing 310. In a resting position, at least the engagement portion 326*b* of chamber lock 326 is engaged with loading member 330 such that loading member 330 is substantially inhibited from rotation about axis A and/or maintained in a substantially stationary rotational position. In embodiments, chamber lock 326 may be at least partially inserted into a portion of a chamber 332 of loading member 330. In embodiments, chamber lock 326 may engage a feature of loading member 330 other than or in addition to chambers 332, such as a groove, ledge, divot, or tab.

Figure 7C:
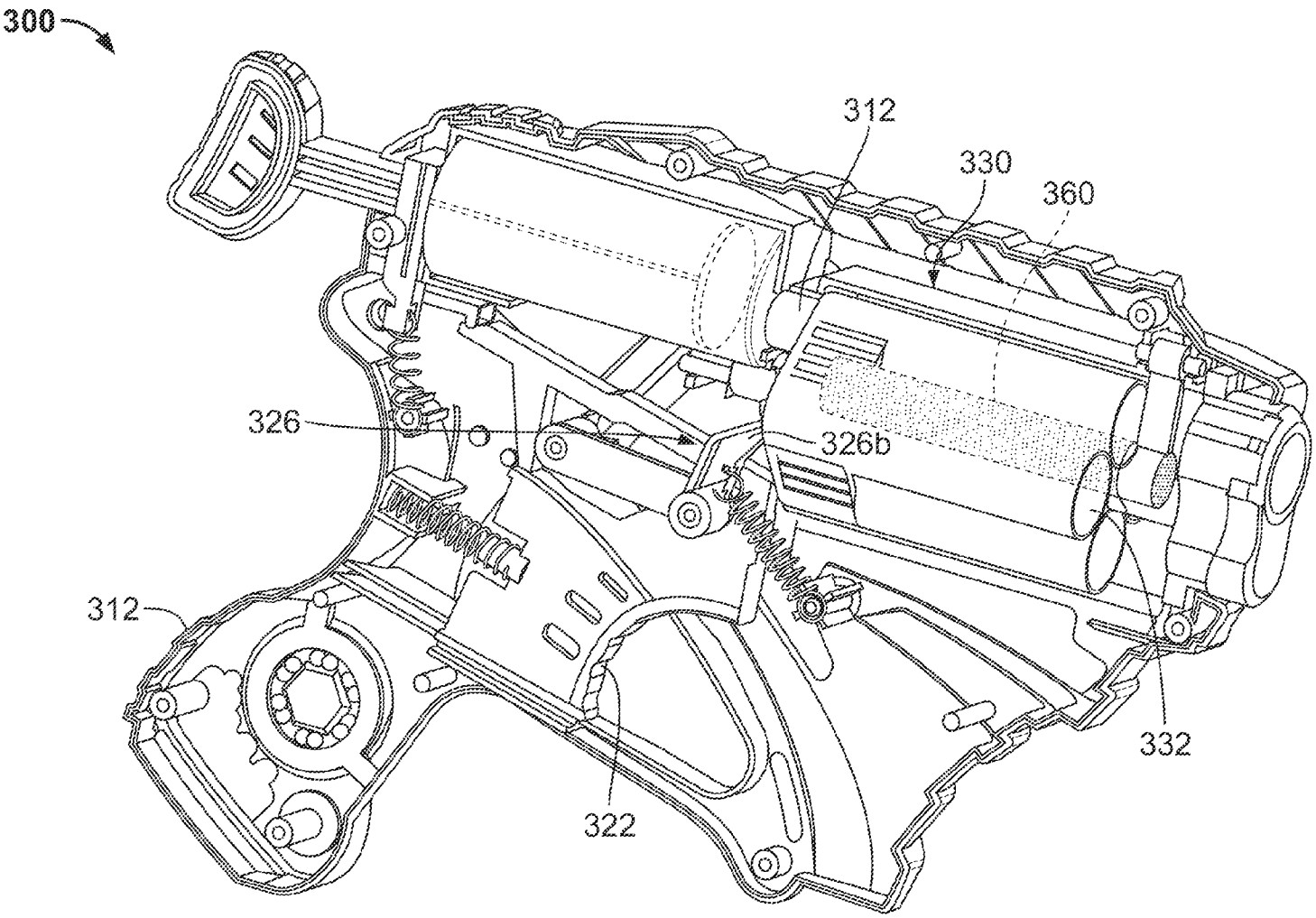
FIG. 7C is a perspective view, shown partially in cut-away, of the dart launcher of FIG. 7A, with the dart rotated to a second rotational position.

Referring to FIG. 7C a user may engage and squeeze movable trigger 322 so that the engagement portion 326*b* of chamber lock 326 is moved out of engagement with a chamber 332. Disengagement of the chamber lock 326 with loading member 330 may allow the loading member 330 to rotate substantially uninhibited so that loading member 330 may be rotated, such as by a biasing member, manually, or by a secondary trigger (not shown). The user may move the movable trigger 322 or otherwise cause the loading member 330 to rotate into a desired rotational position to dispose dart 360 in a chamber 332 in a 9:00 position from the perspective of the user behind the handle portion 312. A user may release movable trigger 322 or otherwise move chamber lock 326 so that chamber lock 326 returns to a resting position engaged with loading member 330 to inhibit further rotation of loading member 330 past a desired rotational position.

Figure 7D:
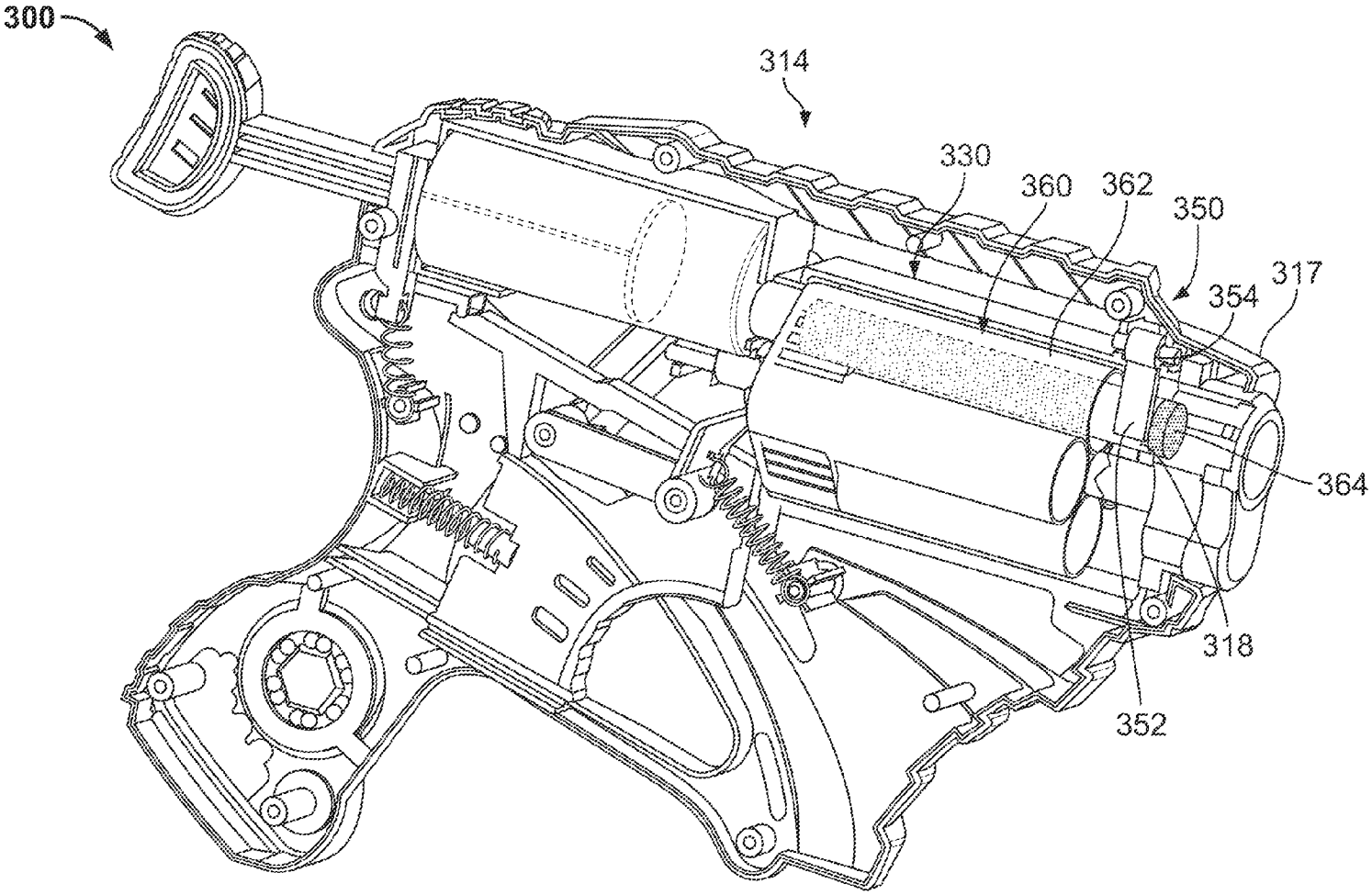
FIG. 7D is a perspective view, shown partially in cut-away, of the dart launcher of FIG. 7A, with the dart rotated to a third rotational position and engaging a safety arm.

Turning to FIG. 7D, additional rotation of the loading member 330 may cause head portion 364 and/or body 362 of dart 360 to rotationally engage and contact safety arm 350. Additional rotation of loading member 330 may cause dart 360 to rotationally engage and move, such as pivot or deform, at least body 352 of safety arm 350 radially away from the launching section 318 of the barrel portion 314 so that safety arm 350 is in a second, actuated position. Dart 360 may be positioned within the launching section 318 of barrel portion 314 such that dart 360 is positioned in substantial alignment with barrel 316 and/or muzzle 317 so that dart 360 may be positioned along axis B (FIG. 7B) or a 12:00 position on loading member 330 from the perspective of a user standing behind the dart launcher 300. In this manner dart 360 may be disposed along a substantially clear path within dart launcher 300.

Figure 7E:
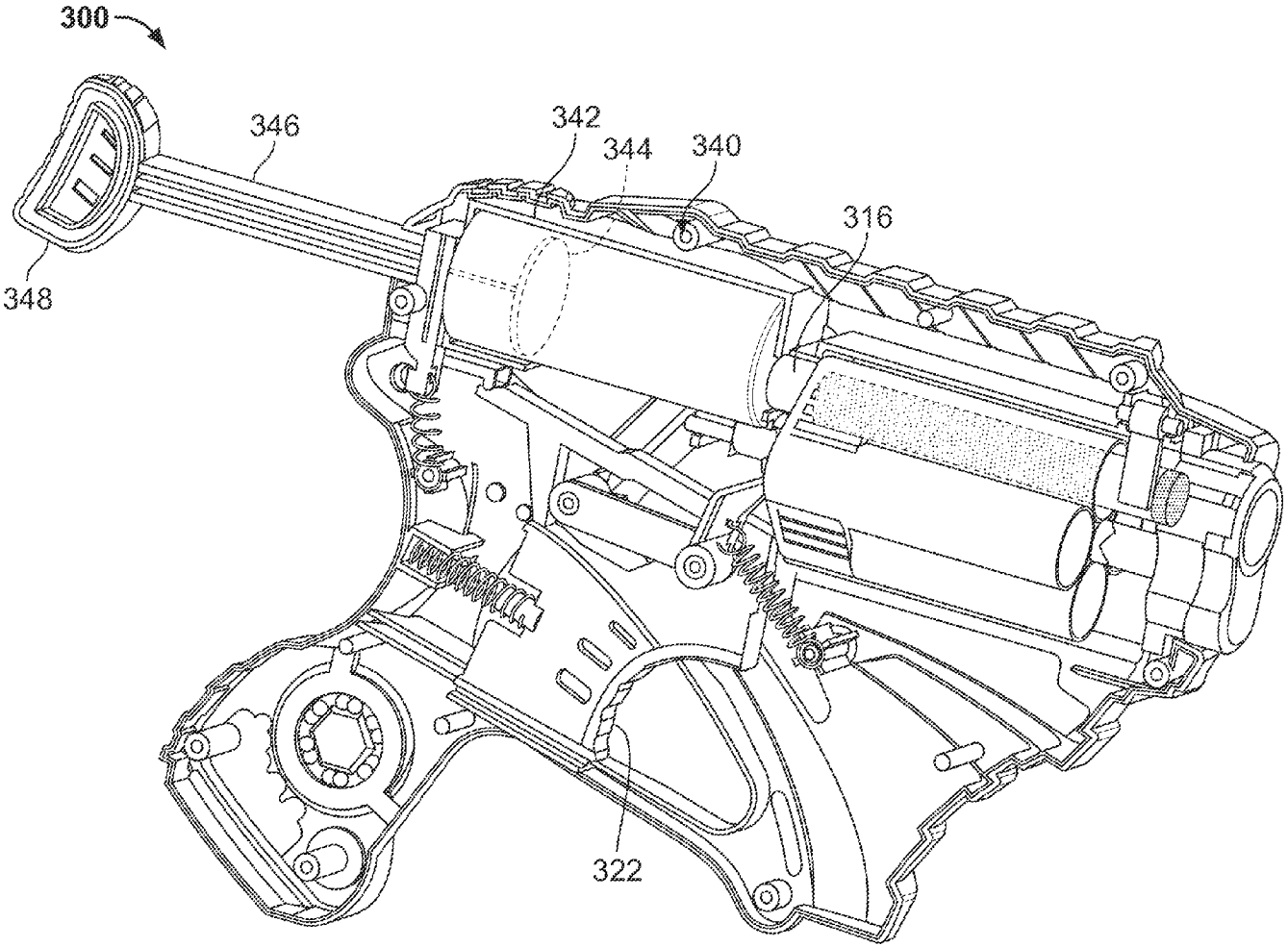
FIG. 7E is a perspective view, shown partially in cut-away, of the dart launcher of FIG. 7A, with a piston handle in a retracted position.

Referring to FIG. 7E, a user may then engage and pull plunger handle 348 such that plunger arm 346 moves plunger 344 to a rearward position within piston tube 342. Rearward movement of the plunger 344 may create an at least partial vacuum within piston tube 342 to draw fluids into piston tube 342.

Figure 7F:
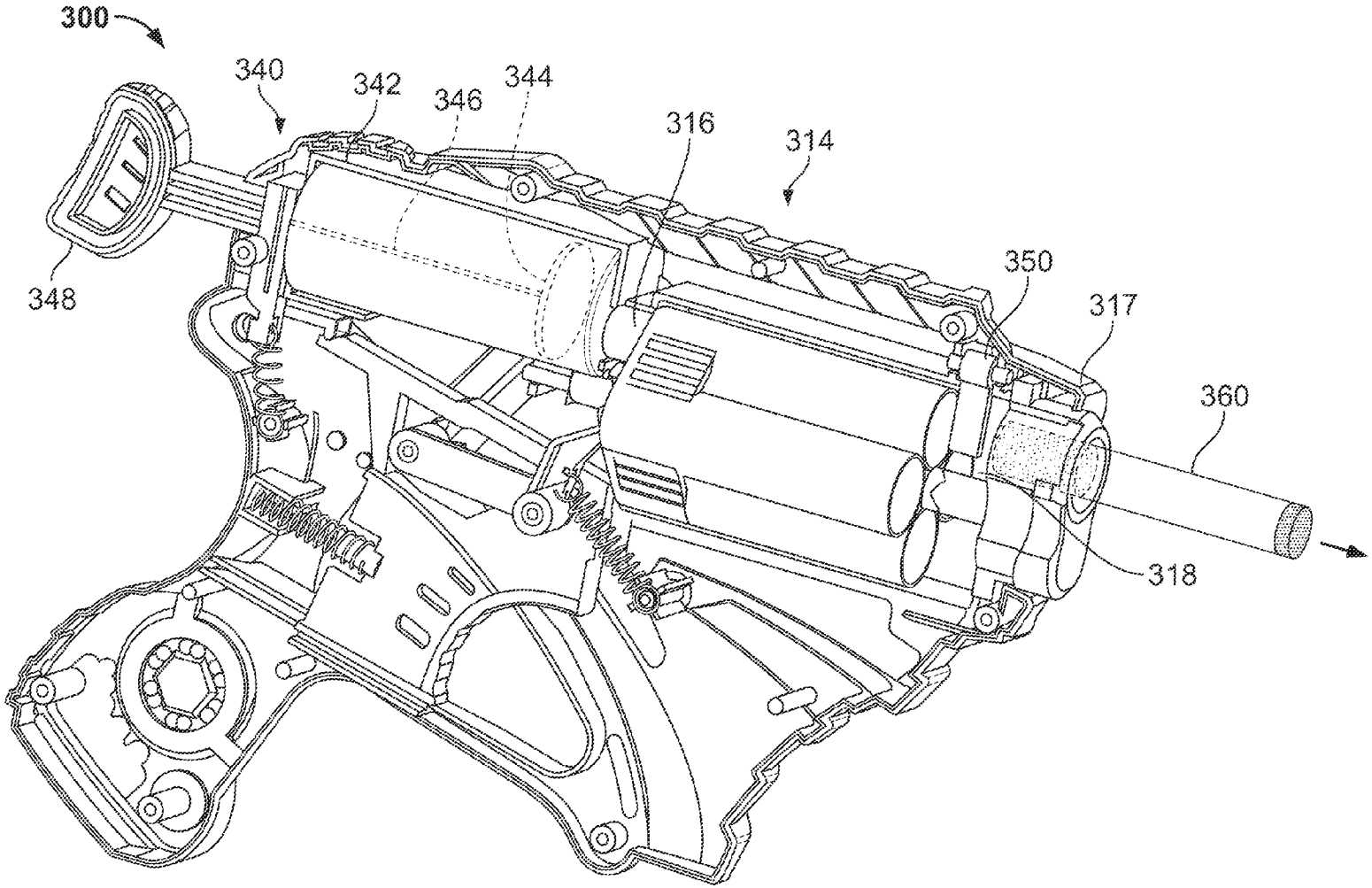
FIG. 7F is a perspective view, shown partially in cut-away, of the dart launcher of FIG. 7A, with a dart being launched therefrom.

Turning to FIG. 7F, a user may then cause the plunger 344 to be advanced forwardly through the piston tube 342. In embodiments, plunger 344 may be moved by disengagement of a lock via movement of movable trigger 322 or another actuation mechanism, or through manual forcing of plunger handle 348 and plunger arm 346. Forward movement of the plunger 344 through the piston tube 342 may positively pressurize fluids within piston tube 342 so that fluids are expelled from piston tube 342. Fluids may be forcibly expelled from piston tube 342 may enter into the barrel portion 314 of housing 310 via fluid tubes or conduits (not shown), so that fluids behind the dart 360 are pressurized to create a pressure differential so that fluid pressure rear of the dart 360 is greater than a pressure ahead of the dart, to force dart 360 through barrel 316, launching section 318, and muzzle 317 so that dart 360 is launched from dart launcher 300. After dart 360 has been launched from dart launcher 300, safety arm 350 may return to its initial position extending at least partially across launching section 318. In embodiments, safety arm 350 may return to its initial position under a biasing force and/or under the influence of gravity. In this manner, safety arm 350 may be configured to automatically return to an initial or resting position following a launching of a dart 360. In embodiments, a user may opt to not launch a dart 360 when dart 360 is aligned in the launching section 318, and may rotate the loading member 330 such that the dart 360 is disposed in a different rotational position. In such embodiments, safety arm 350 may also be configured to return to a resting or initial condition following movement of a dart 360 away from the launching section 318. In embodiments, loading member 330 includes multiple darts 360 such that the dart launcher 300 is configured to separately and sequentially load darts 360 into launching section 318 of barrel portion 314 for launching.

In embodiments, a user may aim or point the muzzle 317 and/or other portions of barrel portion 314 or housing 310 toward a target such that a dart 360 is positioned to launch toward a designated surface. In embodiments, a target may be a person, a marked object, or an unmarked object, to name a few. In embodiments, a user may launch a dart 360 without aiming a portion of the housing 310. In embodiments, dart launcher 300 may launch a dart 360 toward a non-target surface such as a random or accidentally accessed location or object.

Figure 8:
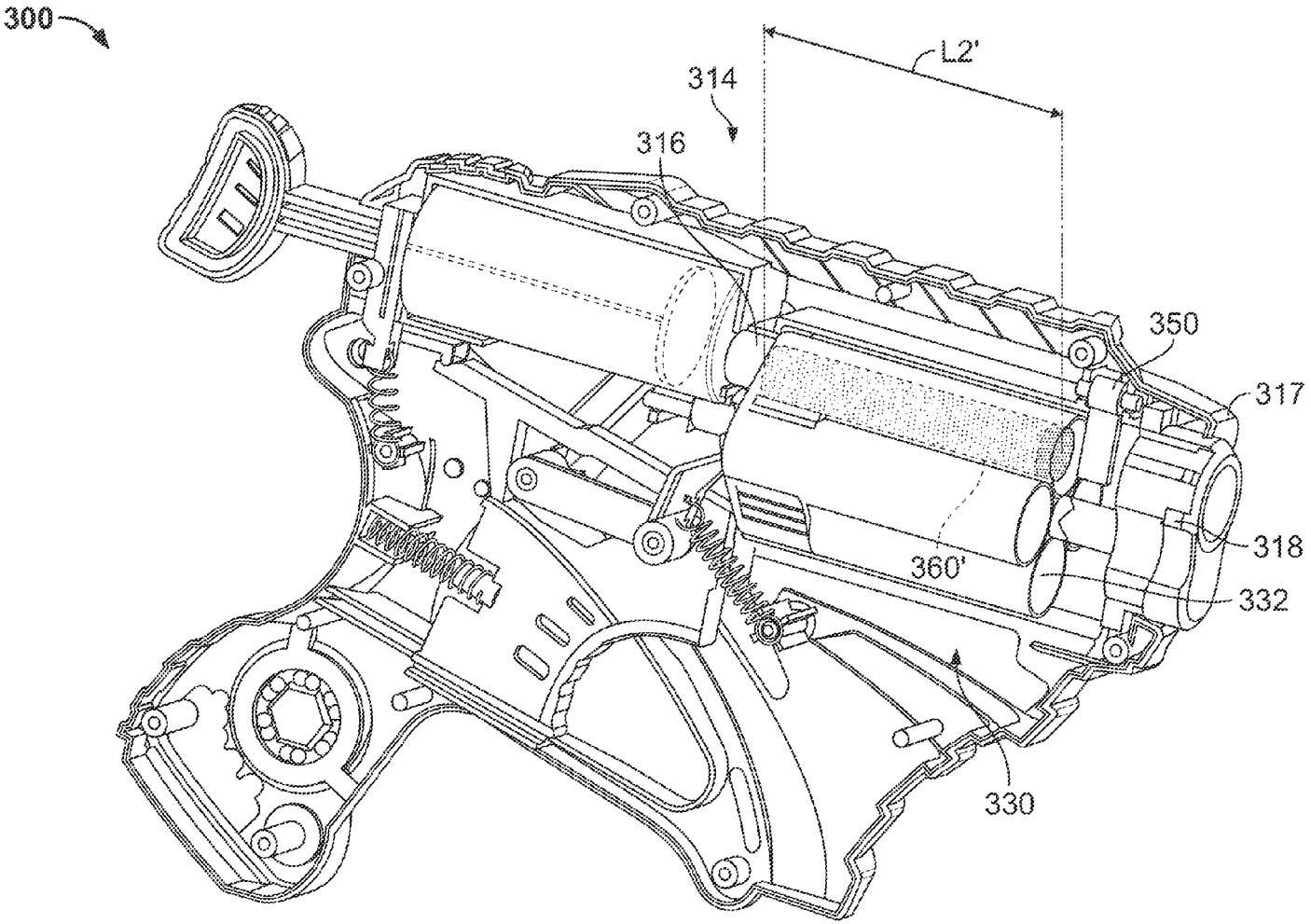
FIG. 8 is a perspective view, shown partially in cut-away, of the dart launcher of FIG. 7A, with a non-standard dart inserted therein.

Turning now to FIG. 8, dart launcher 300 is shown with a non-standard dart 360' disposed in a chamber 332 of loading member 330 in a 12:00 position from the perspective of a user behind the handle portion 312 so that non-standard dart 360' is aligned with barrel portion 314. Dart 360' may have a non-standard length L2' that is less than the length L2 of dart 360. Non-standard dart 360' may have a length L2' that is less than a minimum threshold length associated with a dart that may be safely or properly launched from dart launcher 300. In embodiments, if length L2' is less than a minimum threshold length associated with a dart that may be safely launched from dart launcher 300, non-standard dart 360' may not have a sufficient length to engage safety arm 350 upon rotation into the 12:00 position of loading member 330. Accordingly, safety arm 350 may remain in an initial or resting position such that safety arm 350 extends at least partially across launching section 318 to inhibit passage of non-standard dart 360' into a forward portion of launching section 318 and/or muzzle 317. In this manner, safety arm 350 may provide a safety feature that inhibits the launching of a non-standard dart 360' having a length L2' less than a minimum threshold length associated with a dart that may be safely launched from dart launcher 300. In embodiments, safety arm 350 may inhibit the passage of an object other than a dart, such as another object having a length less than the minimum threshold length, through launching section 318.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A dart launcher, comprising:

a housing including a launching section disposed along a linear path including an exit of the housing;

a safety arm movably attached to the housing at a threshold length along the launching section, the threshold length is less than the length of a standard dart;

wherein when a first object having a length less than the threshold length is loaded into the launching section or the launching section is empty, the safety arm extends at least partially into the launching section in an initial position, and wherein when a first dart having at least the threshold length is loaded into the launching section, the safety arm is raised away from the first dart into a second position;

a biasing member engaged with the safety arm so that biasing member maintains a bias on the safety arm toward the initial position; and a trigger movable with respect to the housing and in mechanical cooperation with a launching mechanism, wherein when the first dart is loaded into the launching section, actuation of the trigger causes the first dart to launch through the launching section.

2. The dart launcher of claim 1, wherein the safety arm is pivotably attached to the housing.

3. The dart launcher of claim 2, wherein the safety arm is pivotably attached to a post formed on the housing.

4. The dart launcher of claim 1, wherein when the first object is loaded into the launching section, the safety arm in the initial position blocks movement of the first object through the launching section.

5. The dart launcher of claim 1, wherein the launching mechanism comprises a piston tube configured to intake, store, and/or transmit pressurized fluids.

6. The dart launcher of claim 5, wherein the piston tube is in fluid communication with the launching section.

7. The dart launcher of claim 6, wherein the piston tube is pressurizable with air.

8. The dart launcher of claim 1, wherein the safety arm comprises a hub attached to the housing and an elongate body extending away from the hub.

9. The dart launcher of claim 8, wherein in the initial position the body of the safety arm extends into the launching section at an angle between and including 0 degrees and 90 degrees with respect to a top interior surface of the housing.

10. The dart launcher of claim 8, wherein the hub comprises an opening to receive a pin.

11. The dart launcher of claim 8, wherein the hub comprises a stop that contacts a corresponding ledge on the housing to limit a range of motion of the safety arm.

12. The dart launcher of claim 8, wherein the body of the safety arm tapers along its length.

13. The dart launcher of claim 1, wherein the safety arm has a cross-sectional configuration selected from the group consisting of: rectangular, circular, square, and triangular.

14. The dart launcher of claim 1, wherein the safety arm is pivotable in a direction perpendicular to the linear path.

15. The dart launcher of claim 1, wherein the safety arm is movable from the initial position to the second position by insertion of the first dart into the launching section.

16. The dart launcher of claim 1, further comprising a magazine that contains a plurality of darts.

17. The dart launcher of claim 16, wherein the magazine is in mechanical cooperation with the housing such that each dart of the plurality of darts is individually inserted into the launching section in sequence.

18. A dart launcher, comprising:

a housing including a launching section disposed along a linear path including an exit of the housing, the launching section receives one or more objects;

a safety arm pivotably attached to the housing at a threshold length along the launching section so that the safety arm is pivotable in a direction perpendicular to the linear path, the threshold length is less than the length of a standard dart;

wherein when a first object having a length less than the threshold length is loaded into the launching section or the launching section is empty, the safety arm extends at least partially into the launching section in an initial position, and wherein when a first dart having at least the threshold length is loaded into the launching section, the safety arm is raised away from the first dart into a second position;

a biasing member engaged with the safety arm so that biasing member maintains a bias on the safety arm toward the initial position;

a strip comprising a plurality of darts in mechanical communication with the housing, each dart is individually insertable into the launching section in sequence; and a trigger movable with respect to the housing and in mechanical cooperation with a launching mechanism, wherein when the first dart is loaded into the launching section, actuation of the trigger causes the first dart to launch through the launching section.

19. The dart launcher of claim 18, wherein the safety arm is movable from the initial position to the second position by insertion of the first dart into the launching section.

* * * * *